US006402287B2

(12) United States Patent
Matsumoto et al.

(10) Patent No.: US 6,402,287 B2
(45) Date of Patent: Jun. 11, 2002

(54) PRINTING METHOD AND PRINTER CAPABLE OF INSPECTING PRINTING HEAD

(75) Inventors: Nobuo Matsumoto; Kiyotaka Kaneko; Eiichi Kito; Yasuyuki Hosono, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/871,894

(22) Filed: Jun. 4, 2001

(30) Foreign Application Priority Data

Jun. 5, 2000 (JP) ..... 2000-168000

(51) Int. Cl.[7] ..... B41J 29/393; B41J 29/38
(52) U.S. Cl. ..... 347/19; 347/14
(58) Field of Search ..... 347/19, 5, 12, 347/14, 20, 40, 7, 8; 400/625; 358/298

(56) References Cited

U.S. PATENT DOCUMENTS 5,608,430 A * 3/1997 Jones et al. ..... 347/8
6,084,607 A * 7/2000 Matsuda ..... 347/19
6,106,095 A * 8/2000 Jackson et al. ..... 347/19

* cited by examiner

*Primary Examiner*—John Barlow
*Assistant Examiner*—C. Stewart
(74) *Attorney, Agent, or Firm*—McGuireWoods LLP

(57) ABSTRACT

An ink jet printer has an ink jet printing head which includes plural nozzles arranged in a main scan direction. A feeder rollers feed continuous recording sheet relative to the printing head in a sub scan direction. A controller drives the printing head and the feeder rollers to print images and a head check pattern to the continuous recording sheet. The head check pattern is printed outside a region of the images, and adapted to check whether the nozzles print at intended printing density.

33 Claims, 14 Drawing Sheets

PRINTING METHOD AND PRINTER CAPABLE OF INSPECTING PRINTING HEAD

BACKGROUND OF THE INVENTION

1. Field of the Invention

The present invention relates to a printing method and printer. More particularly, the present invention relates to a printing method and printer in which a printing head can be readily inspected, and failure in printing can be detected with certainty.

2. Description Related to the Prior Art

Printers of various types are known, including an ink jet printer having an ink jet printing head, and a thermal printer having a thermal head. It is likely in the ink jet printer that failure occurs in operation of nozzles or recording elements of the printing head because of certain reasons. For example, choking of ink may occur in the nozzles. An abnormal situation of a drop of the ejected amount occurs. Furthermore, the nozzles come not to eject ink. Streaks occur in imaged printed by the printing head because of unevenness in color or density.

To inspect the printing head, printed images are observed. If streaks occur due to unevenness in color or density, then a cleaning mode is set to clean the printing head to eliminate choking of the ink or remove abnormality in a direction of ejecting the ink. In the cleaning, the ink is ejected through the nozzles at a high flow rate. Also, the ink is sucked externally from the nozzles. Furthermore, the nozzles are wiped. If the failure is eliminated according to manual operation, it is likely that discovery of choking of the ink is too late, to print an image with very low quality. Unlike a printer used personally at home by a user, a commercial use of the printer at a shop or by a dealer requires high quality in printing. If failure in operation of the nozzles is discovered too late, reliability in printing at the shop to customers is seriously lowered.

SUMMARY OF THE INVENTION

In view of the foregoing problems, an object of the present invention is to provide aprinting method and printer in which a printing head can be readily inspected, and failure in printing can be detected with certainty.

In order to achieve the above and other objects and advantages of this invention, a printer has a printing head, including plural recording elements arranged in a main scan direction. A moving mechanism moves one of the printing head and recording material relative to a remainder thereof in a sub scan direction. A controller drives the printing head and the moving mechanism to print at least one image and a head check pattern to the recording material, the head check pattern being printed outside a region of the image, and adapted to check whether the recording elements print at intended printing density.

Furthermore, a frame memory is connected with the controller, for storing information of the image. A pattern memory is connected with the controller, for storing information of the head check pattern.

The at least one image is plural images, and the head check pattern is printed to the recording material in a position between the plural images, in a position defined upstream therefrom, or in a position defined downstream therefrom.

Furthermore, a pattern reader reads the head check pattern. The controller designates failing recording elements among the plural recording elements by extracting pixels with low printing density within the head check pattern being read.

The controller causes the printing head to print cutting indicia to the recording material in respectively positions between the plural images, the cutting indicia being adapted to cut the recording material.

The controller, before printing the head check pattern, causes the printing head to print a trial printed pattern to the recording material.

The head check pattern and the trial printed pattern are combined to constitute at least one of the plural cutting indicia.

The printing head is an ink jet printing head, the plural recording elements are constituted by plural nozzles for ejecting an ink droplet to the recording material. The trial printed pattern is printed for cleaning the nozzles.

The printing head prints the head check pattern before printing the image. The controller, after printing the image, further causes at least failing nozzles among the plural nozzles to eject an ink droplet, to print a second trial printed pattern to the recording material.

The controller, after printing the second trial printed pattern, causes the printing head to print a second head check pattern to the recording material, the second head check pattern being adapted to check whether the nozzles print at intended printing density. The second head check pattern and the second trial printed pattern are combined with one another to constitute the cutting indicia.

The printing head prints the head check pattern in association with each of the plural images, or prints the head check pattern in a position between plural series of the images, or prints the head check pattern upon lapse of predetermined time, or prints the head check pattern when a roll of the recording material is replaced with a roll of new recording material.

The plural series are associated with respectively one request for printing, or each of the plural series includes a predetermined number of images.

The recording material is continuous recording sheet or a recording sheet strip. The controller further causes the printing head to print a sorting indicia to the recording material in a position between plural series of the images, the sorting indicia being discernible from the cutting indicia and adapted to designating the series of the images.

The sorting indicia is different from the cutting indicia in at least one of a width, length, position, color and shape.

The cutting indicia are constituted by respectively a combination of the head check pattern and a first type of the trial printed pattern, and the sorting indicia is constituted by respectively a combination of the head check pattern and a second type of the trial printed pattern, the second type being discernible from the first type.

The failure designating step includes generating an alarm signal for recovery of the failing recording elements.

Furthermore, after the failure designating step, ink is sucked from failing nozzles among the plural nozzles for recovery, or the failing nozzles are wiped for recovery.

In a preferred embodiment, the moving mechanism comprises a head carriage for moving the printing head in the sub scan direction for image printing in a belt shape. Furthermore, a second moving mechanism moves one of the head carriage and the recording material relative to a remainder thereof in the main scan direction, to print the image.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
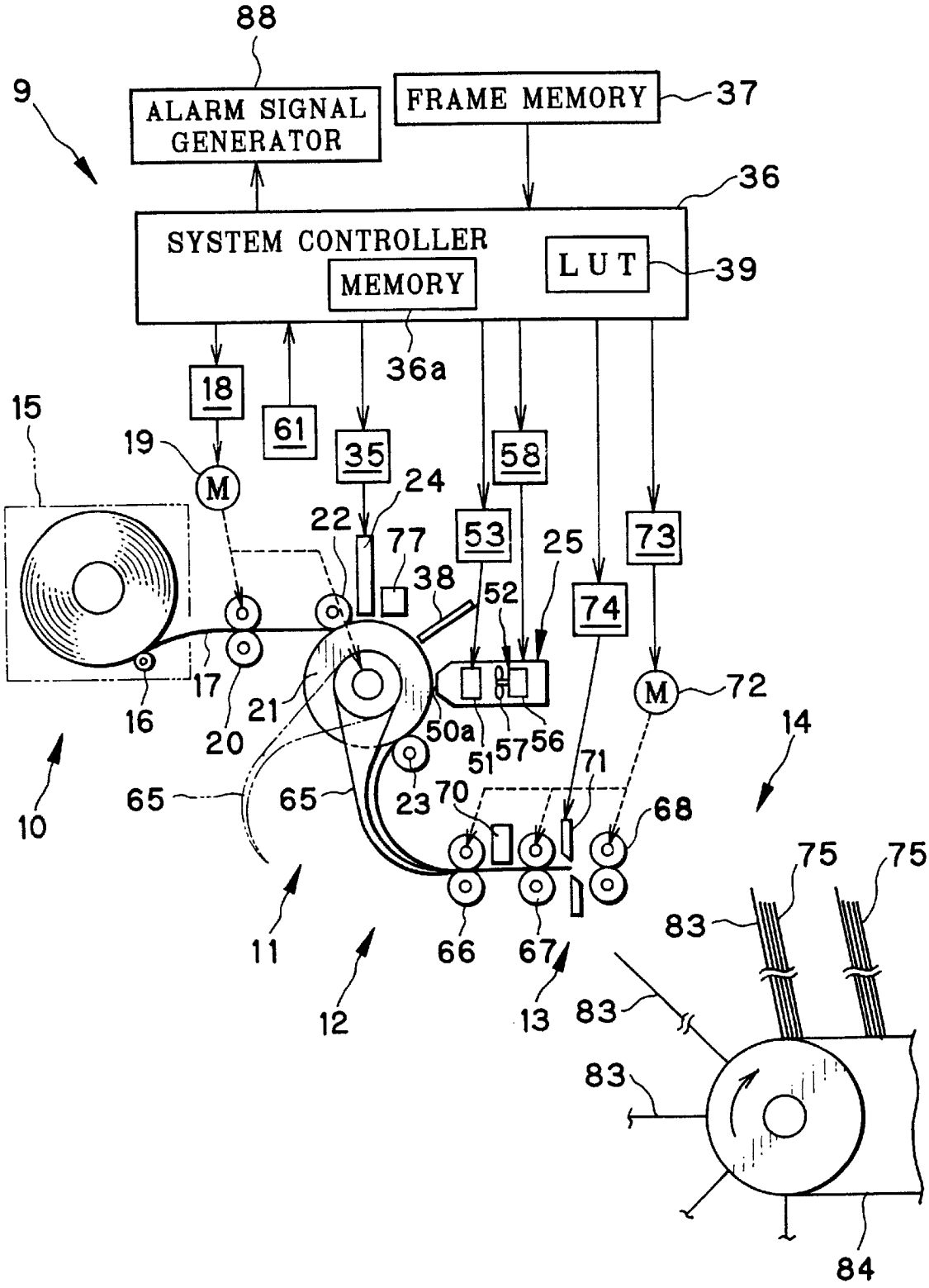
FIG. 1 is an explanatory view in elevation, illustrating an ink jet printer of the invention.

In FIG. 1, an ink jet printer 9 is illustrated, and is constituted by a sheet supply unit 10, an image forming component 11, a sheet reservoir 12, a cutter 13 and a sorter 14. A recording sheet magazine 15 is provided with a supply roller 16, which is rotated by the sheet supply unit 10 to unwind and advance continuous recording sheet 17 as recording material from the recording sheet magazine 15. The continuous recording sheet 17 is supplied to the image forming component 11. In the present embodiment, the continuous recording sheet 17 is 100 mm wide. Each of image frames to be printed in the continuous recording sheet 17 has a format of a postcard having a size of approximately 150 mm in the feeding direction. Of course, the width of the continuous recording sheet 17 and the size of each image frame may be changed in a suitable manner.

The image forming component 11 is constituted by a feeder roller set 20, a platen roller 21, pinch rollers 22 and 23, an ink jet printing head 24 and a drier 25. The feeder roller set 20 and the platen roller 21 in combination operate as moving mechanism. A motor 19 is driven by a motor driver 18, and causes the feeder roller set 20 and the platen roller 21 to rotate. The pinch rollers 22 and 23 rotate in contact with the platen roller 21, and keep the continuous recording sheet 17 pressed against the platen roller 21. In the present embodiment, the pinch rollers 22 and 23 are disposed so as to set a range of 180 degrees about the platen roller 21 for contact of the platen roller 21.

The printing head 24 and the drier 25 are disposed between the pinch rollers 22 and 23 and arranged in a sub scan direction that is the feeding direction of the continuous recording sheet 17. The printing head 24 and the drier 25 extend in a main scan direction that is crosswise to the feeding of the continuous recording sheet 17.

Figure 2:
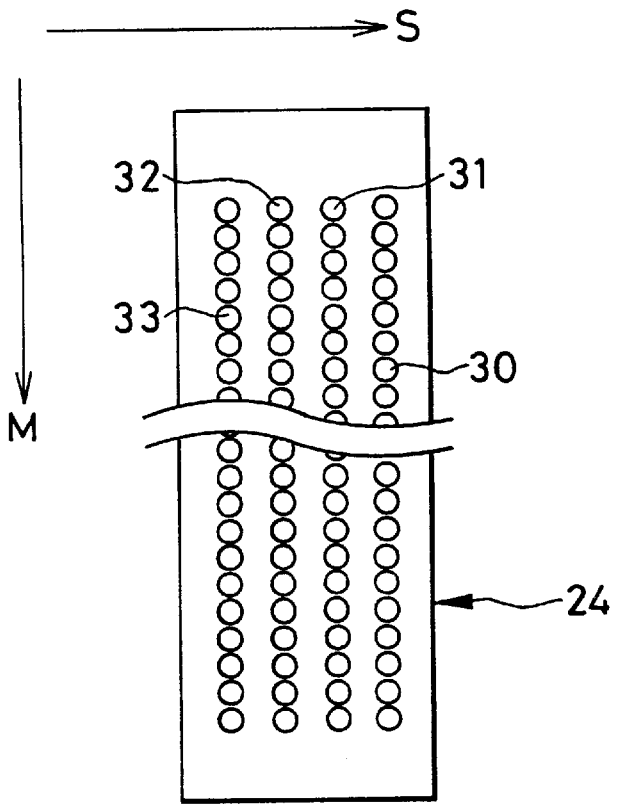
FIG. 2 is a plan illustrating a printing head.

The printing head 24 is disposed at the top of the platen roller 21 and close to a downstream side of the pinch roller 22. In FIG. 2, the printing head 24 includes arrays of nozzles 30, 31, 32 and 33 as recording elements for line printing of four colors including yellow, magenta, cyan and black colors. As is well-known in the art, the printing head 24 accommodates piezoelectric elements disposed in an ink flowing path close to the nozzles 30, 31, 32 and 33. The ink flowing path is shortened or extended by the piezoelectric elements, to eject and supply ink.

As illustrated in FIG. 1, a head driver 35 drives and controls each of piezoelectric elements. The head driver 35 sends the piezoelectric elements a drive signal according to image data. A system controller 36 is connected with the head driver 35. A frame memory 37 is connected with the system controller 36, which writes image data to the frame memory 37, the image data being input by an image reader device or image output device.

The system controller 36 determines drive data for the piezoelectric elements in the nozzles 30–33 according to image data of the respective colors. The drive data is sent to the head driver 35. Then the system controller 36 causes the head driver 35 to drive the piezoelectric elements in synchronism with feeding of the continuous recording sheet 17. Ink droplets in a size and a number according to the image data is ejected toward the continuous recording sheet 17, and deposited to the continuous recording sheet 17. Therefore, a full-color image is printed to the continuous recording sheet 17 with ink of yellow, magenta, cyan and black colors.

A pattern memory 36a at the system controller 36 stores data for creating indicia. According to the indicia creating data, the system controller 36 operates for printing a cutting indicia 41 and a sorting indicia 42 at each of borderlines of images 40. See FIG. 3.

Figure 4:
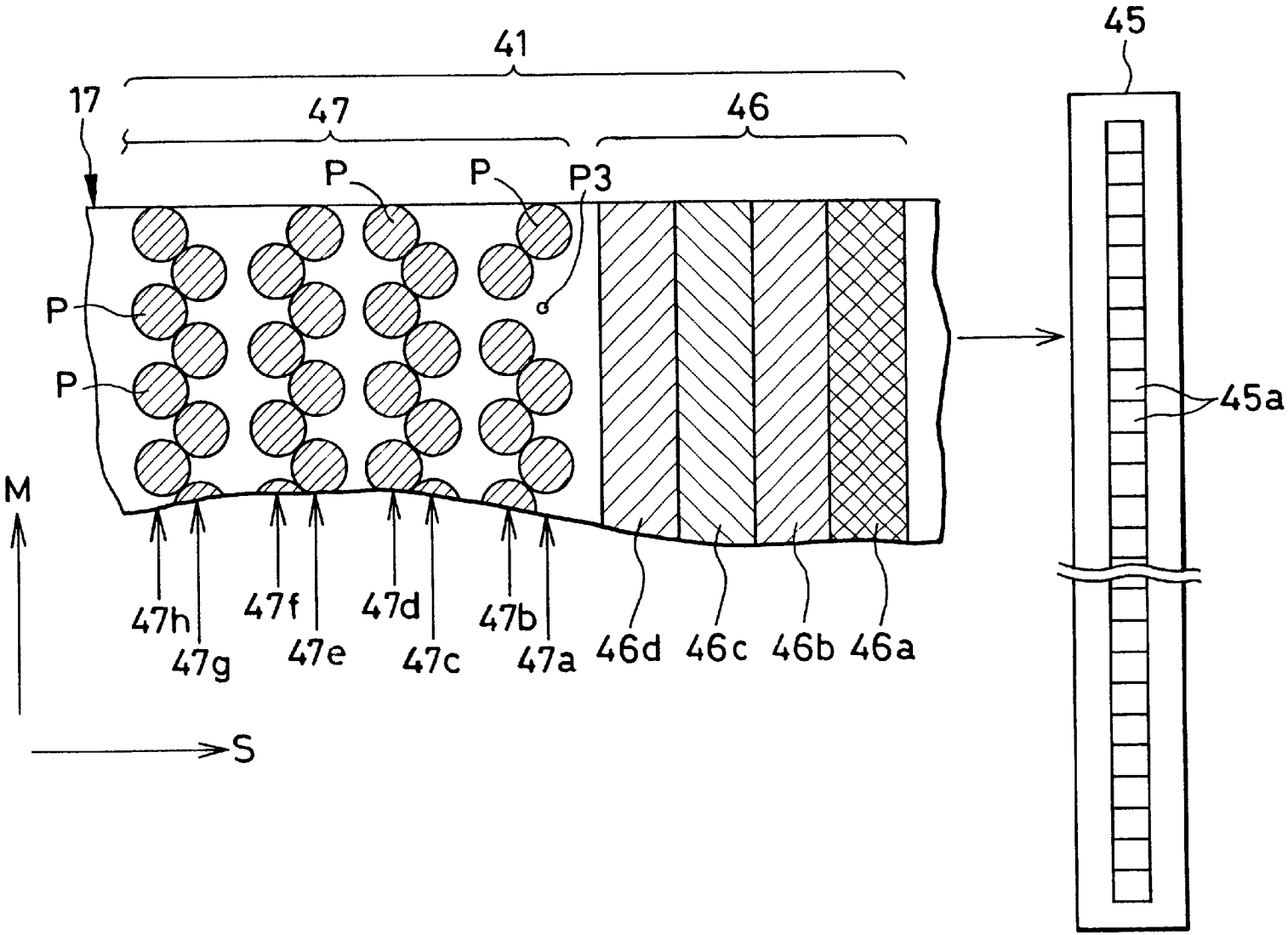
FIG. 4 is an explanatory view in plan, illustrating the cutting indicia including one trial printed pattern.

In FIG. 4, the cutting indicia 41 is depicted in enlargement together with a pattern reading line sensor 45. The cutting indicia 41 is constituted by a trial printed pattern 46 and a head check pattern 47. The trial printed pattern 46 is formed by ejection of ink at a predetermined amount through each of the nozzles for the purpose of cleaning. Forming of the trial printed pattern 46 is effective in removing choking of the nozzles with ink.

In the present embodiment, patterned colored zones 46*a*, 46*b*, 46*c* and 46*d* of black, yellow, magenta and cyan colors are formed on the continuous recording sheet 17 and arranged in the sub scan direction. To form those, the nozzles 30–33 respectively eject ink of the black, yellow, magenta and cyan colors. Note that there is no overlapping between the patterned colored zones 46*a*–46*d*. This is effective in quick drying of ink at the patterned colored zones 46*a*–46*d*. However, it is furthermore possible that overlapped portions exist between the patterned colored zones 46*a*–46*d*.

The head check pattern 47 is constituted by patterned lines 47*a*–47*h*. The patterned lines 47*a* and 47*b* are black. The patterned lines 47*c* and 47*d* are yellow. The patterned lines 47*e* and 47*f* are magenta. The; patterned lines 47*g* and 47*h* are cyan. Each of the patterned lines 47*a*–47*h* includes dots arranged in the main scan direction at a regular pitch that is higher than a pitch of the pixels. In other words, dots in each of the patterned lines 47*a*–47*h* are arranged regularly at a distance from one another. In the sub scan direction, a pitch of arrangement of the patterned lines 47*a* and 47*b* is equal to that of the dots in the main scan direction. The pitch of arrangement of the patterned lines 47*a* and 47*b* is equal to that of the patterned lines 47*c* and 47*d*, of the patterned lines 47*e* and 47*f*, and of the patterned lines 47*g* and 47*h*. In the present embodiment, the pitch both in the main scan direction and in the sub scan direction is twice as great as a size of each nozzle. Note that this pitch may be N times as great as the size of each nozzle, where N is an integer more than 1. Thus, N patterned lines are formed for each of the colors.

As there occurs a space between; pixels P, it is easy to associate the nozzles 30–33 with the pixels printed by the nozzles 30–33. It is likely that density of arrangement of photo receptor elements 45*a* in the pattern reading line sensor 45 is smaller than that of the pixels P in relation to reading the head check pattern 47. However, the space between the pixels P reliably facilitates association of the nozzles 30–33 with the pixels printed by the nozzles 30–33.

Figure 5:
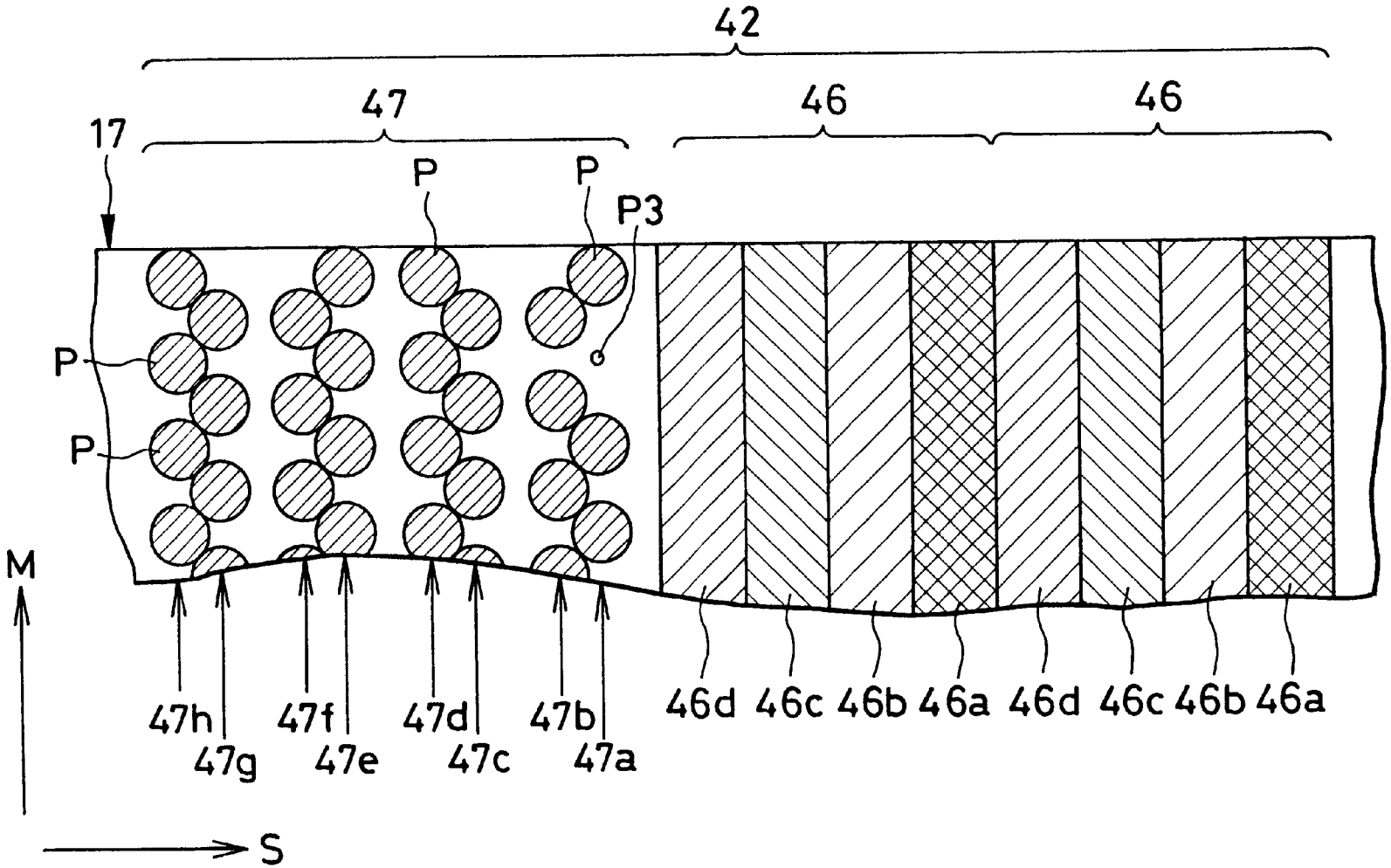
FIG. 5 is an explanatory view in plan, illustrating the sorting indicia including two trial printed patterns.

In FIG. 5, the sorting indicia, 42 is constituted by a combination of the trial printed pattern 46 and the head check pattern 47 in a manner similar to the cutting indicia 41. To form the sorting indicia 42 distinctly from the cutting indicia 41, the two trial printed patterns 46 are included in the sorting indicia 42. The sorting indicia 42 is different in the size from the cutting indicia 41 in the sub scan direction because of the numbers of the trial printed patterns 46. This is effective in discerning the cutting indicia 41 from the sorting indicia 42 without fail.

Figure 6:
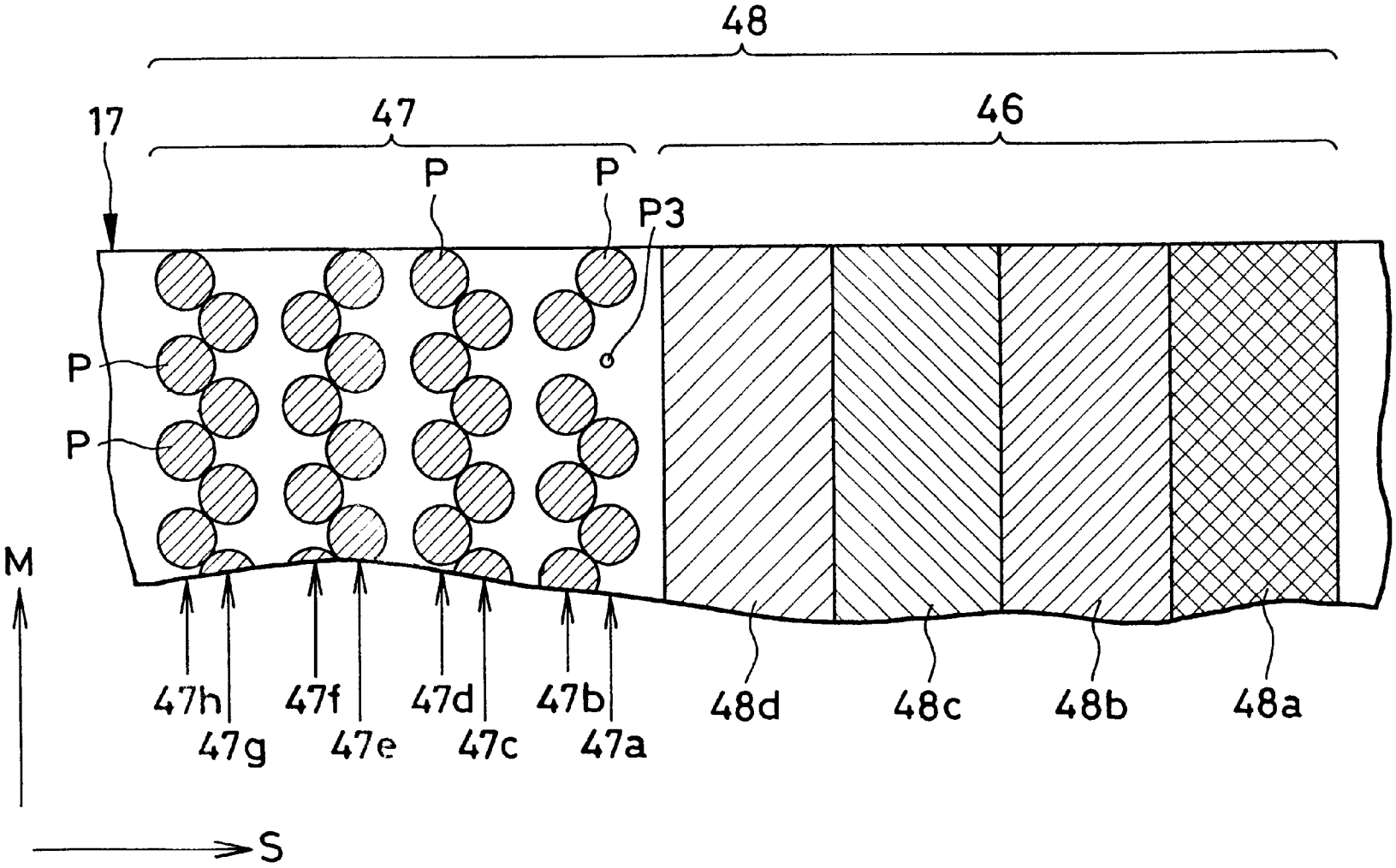
FIG. 6 is an explanatory view in plan, illustrating a sorting indicia having one trial printed pattern in a larger size.

Note that, instead of setting a difference between the cutting indicia 41 and the sorting indicia 42 by changing the number of the trial printed pattern 46, it is possible to change a size of the patterned colored zones 46*a*–46*d* with reference to the feeding direction in the trial printed pattern 46 to determine a difference between the cutting indicia 41 and the sorting indicia 42. FIG. 6 illustrates another preferred embodiment. A sorting indicia 48 can have patterned colored zones 48*a*–48*d* in as great a size with reference to the feeding direction as that of the patterned colored zones 46*a*–46*d* of the cutting indicia 41. Furthermore, arrangement of colors of the patterned colored zones 46*a*–46*d* of the cutting indicia 41 may be changed for discerning the cutting indicia 41 from the sorting indicia 42. Also, the sorting indicia 42 may be different from the cutting indicia 41 in any of the width, length, position, color and/or shape.

In the present embodiment, both the dot diameter control and dot density control are used for expressing gradation so as to produce a print with high quality. However, only one of the dot diameter control and dot density control may be used. Printed lines are arranged at the regular pitch in the sub scan direction S. Image data for driving the piezoelectric elements are output according to differences of the lines of the colors in the sub: scan direction S. Ink droplets for the four colors are; deposited to the same position irrespective of the arrangement of the nozzles 30–33.

In FIG. 1, the drier 25 is positioned downstream from the printing head 24 in a rotational direction defined about the axis of the platen roller 21 by 90 degrees. This position of the drier 25 enables printing with precision without flow of hot air from the drier 25 toward the printing head 24. A partition 38 is disposed between the printing head 24 and the drier 25 for interception. The partition 38 blocks flow of hot air of the drier 25 toward the printing head 24, and protects the printing head 24 reliably from influence of the hot air. Precision in the printing is raised.

Figure 7:
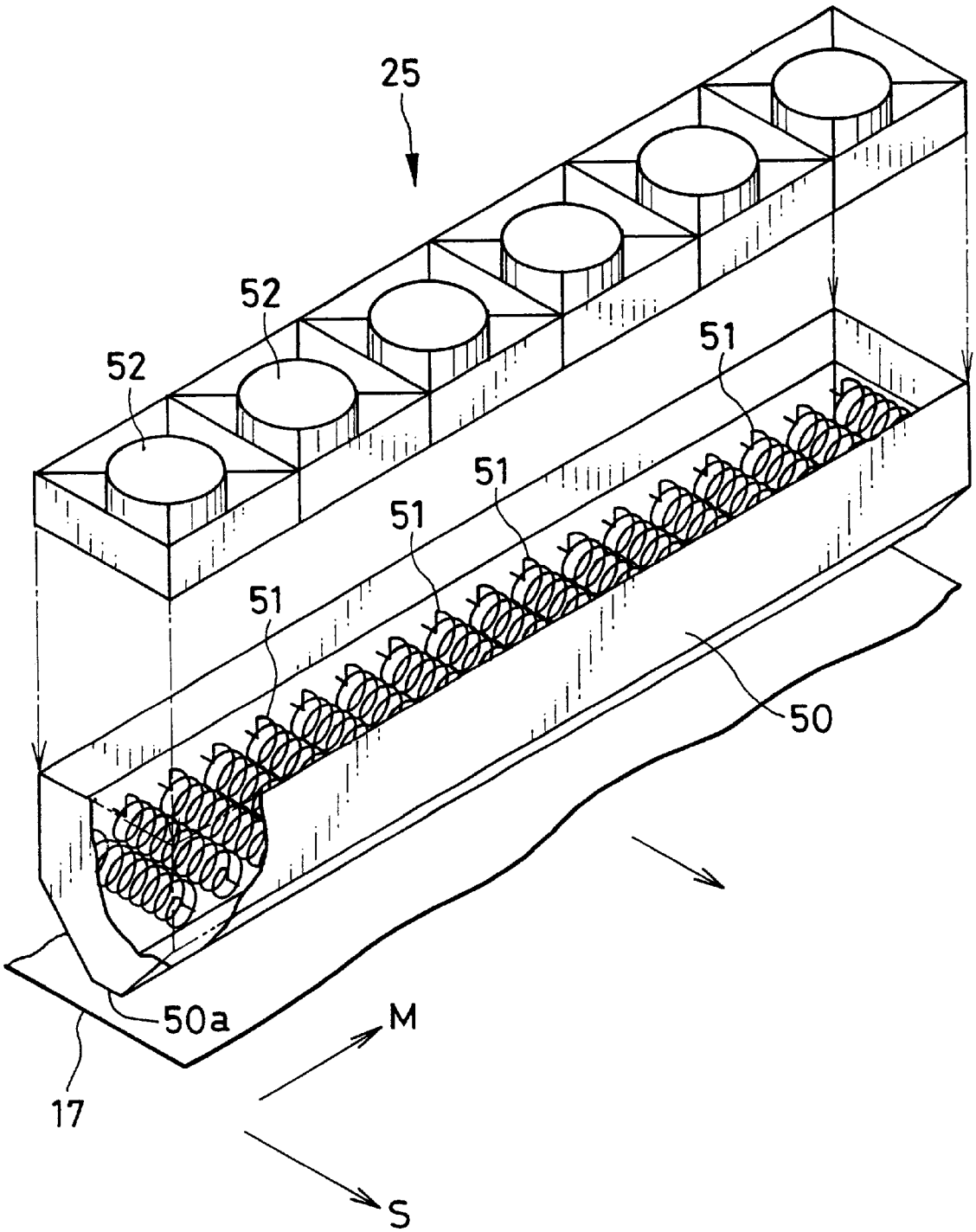
FIG. 7 is a perspective illustrating a drier included in the image forming component.

In FIG. 7, the drier 25 includes a chassis 50, heaters 51 and fans 52. The chassis 50 has a thin box shape. An air supply opening 50*a* is formed in a lower wall of the chassis 50, has a small width like a slit. The heaters 51 include coils, respectively extend in the sub scan direction S, and are arranged in the main scan direction M. In FIG. 1, a heater driver 53 is controlled by the system controller 36, and drives the heaters 51.

Figure 8:
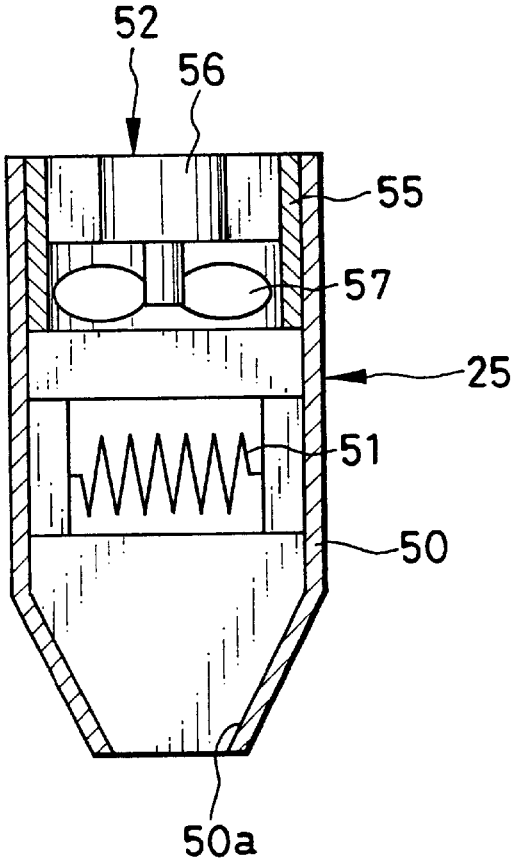
FIG. 8 is a cross section illustrating the drier.

The fans 52 are six box-shaped units in a small thickness, are arranged in the main scan direction M, and are secured to an upper face of the chassis 50. In FIG. 8, the fans 52 have a fan case 55, which accommodates a motor 56 and fan blades 57. A motor driver 58 of FIG. 1 is connected with the system controller 36, and controls the motor 56. The air supply opening 50*a* of the drier 25 emits hot air heated by the heaters 51. Hot air quickly dries the ink deposited on the continuous recording sheet 17.

Figure 9:
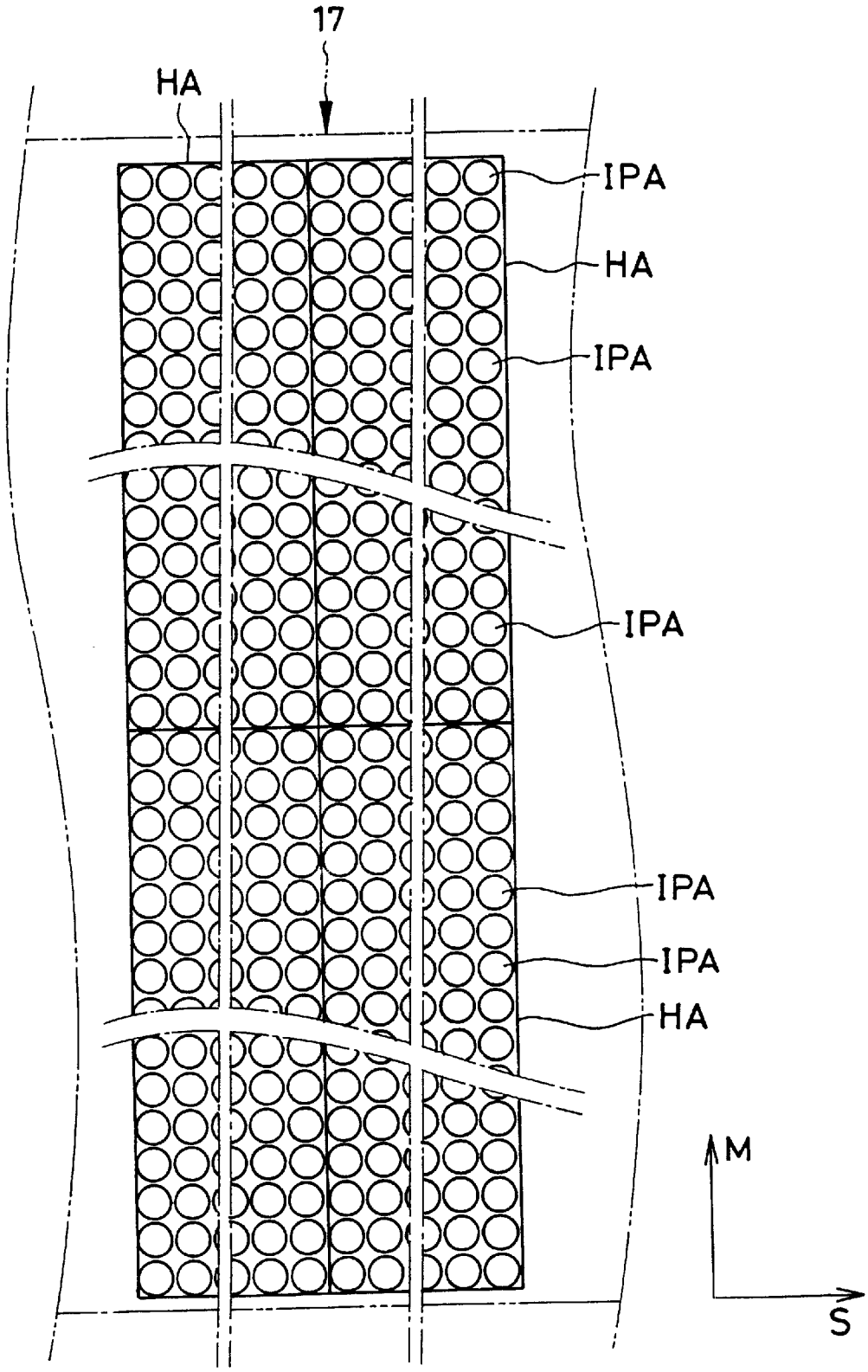
FIG. 9 is an explanatory view in plan, illustrating a relationship between positions of unit drying regions HA and ink ejecting regions IPA.

FIG. 9 illustrates a relationship between unit drying regions HA defined in the continuous recording sheet 17 by respectively the heaters 51, and ink ejecting regions IPA defined by respectively the nozzles. In the present embodiment, each of the unit drying regions HA is defined by 1,000 ink ejecting regions IPA arranged in a matrix form of 100×10 in which 100 are arranged in the main scan direction, and 10 are arranged in the sub scan direction.

Figure 10:
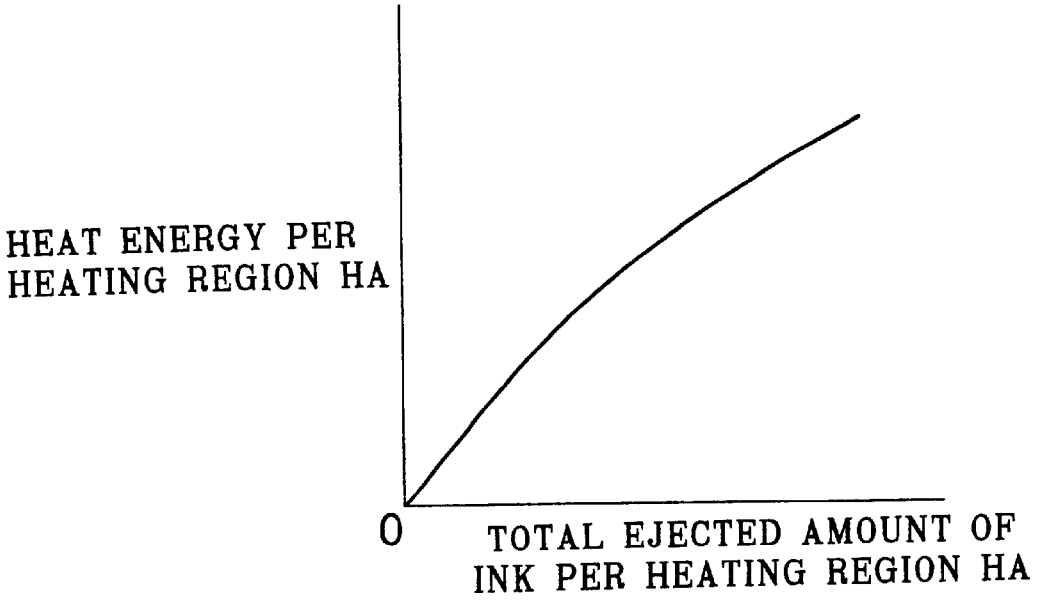
FIG. 10 is a graph illustrating a relationship between heat energy per heating region HA and a total ejected amount of ink per heating region HA.

FIG. 10 is a graph illustrating a relationship between the total ejected amount of the ink for the unit drying region HA and heat energy applied by the heaters 51 to the unit drying region HA. In the present embodiment, the heat energy applied by the heaters 51 is determined higher according to highness in the total ejected amount of the ink for the unit drying region HA. The relationship has been obtained previously by experimental operation. According to the heat energy to be applied to the unit drying region HA obtained from FIG. 10, drive data for the heaters 51 is obtained. In the present embodiment, a relationship is preset between the total ejected amount of the ink for the unit drying region HA and the number of drive pulses or drive data for the heaters 51. A look-up table memory (LUT) 39 in the system controller 36 stores the relationship. According to the image data, the system controller 36 determines the total ejected amount of ink for the unit drying region HA, and obtains the heating data for the heaters 51 in the drier 25 according to the total ejected am6unt. The heaters 51 are driven to dry the ink quickly and reliably.

Therefore, the ink is dried according to the ejected amount on the continuous recording sheet 17, because the heaters 51 operate according to the ejected amount associated with the unit drying region HA. For example, heat energy of the heaters 51 is set higher if a unit drying region HA has been supplied with ink at a higher amount. The ink can be dried quickly with high efficiency. No mixture of undried ink occurs on the continuous recording sheet 17, so drop in the chromaticity and resolving power can be avoided. There occurs no deposit of undried ink to the pinch roller 23. No contamination of the continuous recording sheet 17 occurs with ink.

In FIG. 1, there is a pulse generator 61 connected with the system controller 36 for detecting an amount of feeding the continuous recording sheet 17. The pulse generator 61 contacts the continuous recording sheet 17, and generates pulses in the number proportional to the feeding amount of the continuous recording sheet 17. The system controller 36 counts the number of the pulses from the pulse generator 61, and obtains the feeding amount per unit time. According to the feeding amount, the system controller 36 determines timing of driving the printing head 24 and the heaters 51 in the drier 25. Also, the system controller 36 compensates for drive data of the heaters 51 according to the feeding speed of the continuous recording sheet 17. For example, the heat energy from the heaters 51 is higher according to an increase in the speed of the continuous recording sheet 17. The heat energy from the heaters 51 is lower according to a decrease in the speed of the continuous recording sheet 17. If the feeding speed of the continuous recording sheet 17 is very small and near to zero (0), the heat energy is set as zero to prevent unnecessary heating of the continuous recording sheet 17. It is to be noted that the motor 19 being used can be a stepping motor so the pulse generator 61 may not be used. Drive pulses for the motor 19 can belcounted to determine the timing described above.

The sheet reservoir 12 is constituted by the platen roller 21, the pinch roller 23, a movable guide plate 65 and a feeder roller set 66. The platen roller 21 and the pinch roller 23 are elements in the image forming component 11, while the feeder roller set 66 is an element of the cutter 13. The feeder roller set 66 is rotated at a higher peripheral speed than the platen roller 21, to reserve one portion of the continuous recording sheet 17 by suspending the portion between the pinch roller 23 and the feeder roller set 66. Note that the peripheral speed of the feeder roller set 66 can be equal to or higher than zero.

The movable guide plate 65 is movable pivotally about an axis about which the platen roller 21 rotates. The movable guide plate 65 guides a front edge of the continuous recording sheet 17 toward the cutter 13. An end of the movable guide plate 65, when the front edge of the continuous recording sheet 17 passes, is in a, first position located close to an entrance of the feeder roller set 66 for guiding as indicated by the solid line, and after the front edge of the continuous recording sheet 17 passes, is in a second position for reserving the continuous recording sheet 17 in a looped manner as indicated by the phantom lines. As the portion of the continuous recording sheet 17 is suspended in the space defined by retracting of the movable guide plate 65 in the second position, the continuous recording sheet 17 is reserved.

The cutter 13 is constituted by the feeder roller set 66, feeder roller sets 67 and 68, a pattern reader 70 and cutter blades 71. A motor 72 causes the feeder roller sets 66–68 to rotate. A motor driver 73 is controlled by the system controller 36, and drives the motor 72. A cutter driver 74 is controlled by the system controller 36, and drives the cutter blades 71 to cut the continuous recording sheet 17 along borderlines between images. Thus, prints 75 with the images are produced.

Figure 3:
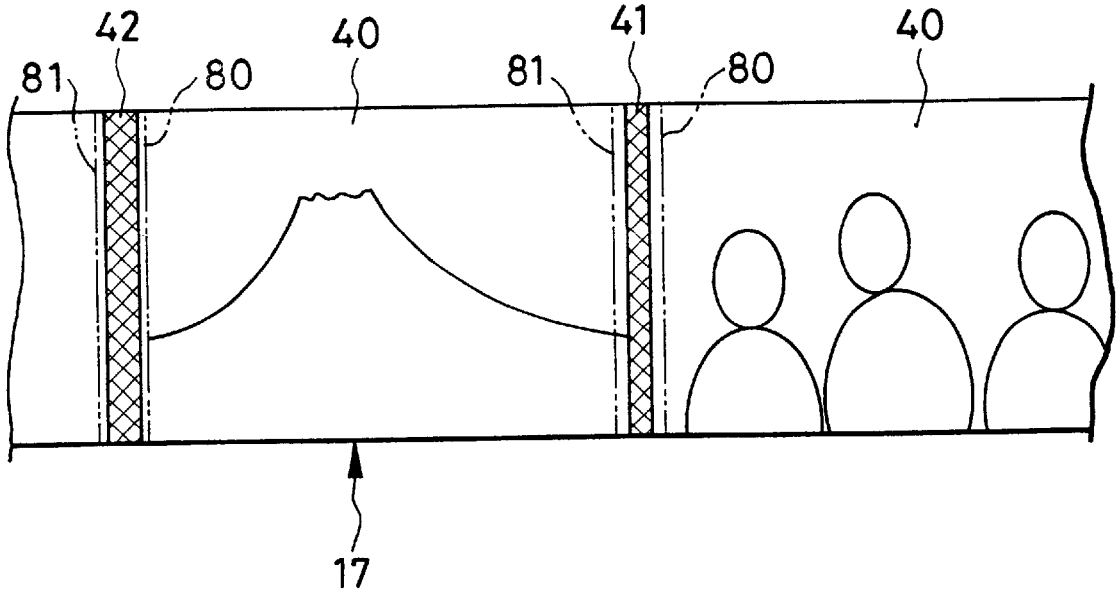
FIG. 3 is a plan illustrating continuous recording sheet with images, a cutting indicia and a sorting indicia printed thereto.

The pattern reader 70 includes the pattern reading line sensor 45 of FIG. 4. The photo receptor elements 45*a* are arranged in the main scan direction M in the pattern reading line sensor 45, and read an image in synchronism with feeding of the continuous recording sheet 17. A detection signal of reading is sent to the system controller 36. According to the detection signal, the system controller 36 detects the cutting indicia 41 or the sorting indicia 42 along each borderline of the images 40 as illustrated in FIG. 3 for discernment.

In the present embodiment, discernment between the cutting indicia 41 and the sorting indicia 42 is due to the number of sets of the trial printed patterns 46, or the area occupied by the trial printed pattern 46. If the one trial printed pattern 46 exists, then existence of the cutting indicia 41 is detected. If the two trial printed patterns 46 exist, then existence of the sorting indicia 42 is detected.

The system controller 36 measures density of each of the pixels P according to the reading signal from the pattern reading line sensor 45 upon reading the head check pattern 47 included in the cutting indicia 41 and the sorting indicia 42. If the density is equal to or lower than reference density, a nozzle having printed the one of the pixels P is detected a failing nozzle. FIG. 4 illustrates an example in which the third pixel P3 in a yellow line pattern as oddnumbered pixel has low density. Thus, a third of the nozzles is detected a failing nozzle.

If failing nozzles are detected, then all the nozzles are cleaned by printing the trial printed pattern 46 in the cutting indicia 41 or the sorting inrdicia 42. Among all the nozzles, ejection of ink through the failing nozzles is at a higher ejected amount of ink and at a higher flow rate through those. Also, ink is ejected through the failing nozzles while nozzle arrays for the colors other than that related to the failing nozzles are cleaned by ink ejection. Therefore, choking of ink can be removed effectively.

If failure of a nozzle is detected even after cleaning failing nozzles, then an alarm signal is generated by an alarm signal generator 88 to inform an operator of choking with ink. In the case of this alarm signal, an auxiliary cleaning mode is designated by an operator to clean the nozzles. For example, heating elements (not shown) are operated in the auxiliary cleaning mode, and apply heat to ink contained in the nozzles, which are caused to eject the heated ink to conduct efficient cleaning. Note that, instead of cleaning by ejection of ink, suction or wiping of ink may be used for cleaning. Also, suction or wiping of ink may be added to ejection of ink. A recovery treating unit 77 is provided and operates for sucking the ink. The printing head 24 is shifted by the recovery treating unit 77 to a recovery position, where a suction head is set at the printing head 24 to clean the nozzles by sucking the ink. Also, the recovery treating unit 77 may have an ink wiping unit, which wipes ink away from the nozzles to clean the printing head 24. The ink wiping unit operates for cleaning as an alternative element in the recovery treating unit 77 instead of the suction head. If choking with ink still remains even after the cleaning process, then the ink jet printing head is replaced with a new printing head.

In response to signals of detecting the cutting indicia 41 and the sorting indicia 42, the system controller 36 controls rotation of the motor 72 and positions borderlines of the continuous recording sheet 17 at the cutter blades 71. In FIG. 3, cutting lines 80 and 81 are used for cutting of the continuous recording sheet 17 by the cutter blades 71 in operation at two times. Thus, the cutting indicia 41 and the sorting indicia 42 are cut away from the continuous recording sheet 17, to obtain the prints 75 having respectively the images 40. After the cutting, each of trays 83 collectively receives the prints 75 in a stacked manner. In response to the detection signal of the sorting indicia 42, the system controller 36 controls the sorter 14 and sets a new one of the trays 83 in a print dropping position. The prints 75 are inserted in the trays 83 per group according to each request for printing. Series of the prints 75 are grouped.

A conveyor belt 84 is included in the sorter 14, and provided with the numerous trays 83 arranged in a predetermined pitch. According to a detection signal of the sorting indicia 42, the conveyor belt 84 is turned by an amount of the pitch of the trays 83, a succeeding one of which is set in the position for receiving drop of prints.

Operation of the above embodiment is described now. When a command signal to start printing is generated upon depression of a printing key, at first the supply roller 16, the feeder roller set 20 and the platen roller 21 are rotated as illustrated in FIG. 1. Thus, the continuous recording sheet 17 is fed to the image forming component 11. A front edge sensor for the continuous recording sheet 17 is disposed close to the printing head 24, and generates a front edge detection signal. The system controller 36 receives the front edge detection signal and a feeding amount signal from the pulse generator 61, and responsively designates a printing region of the continuous recording sheet 17. The nozzles 30–33 eject ink droplets toward the printing region according to image data, and print an image in ink jet printing.

When the continuous recording sheet 17 after ejection of ink is sent to the drier 25, heat energy to be emitted by the heaters 51 is controlled according to the ejected amount of ink to the unit drying region HA. Heat energy according to the ejected amount is applied to the continuous recording sheet 17 for drying ink. Thus, theidrying can be quick.

In FIG. 3, the cutting indicia 41 is printed by the printing head 24 in a position close to a borderline of the images 40. The sorting indicia 42 is printed by the printing head 24 in a position close to a borderline between plural series of the images 40 related to plural printing requests. In FIGS. 4 and 5, all the nozzles are cleaned by ejection of ink at a preset amount and at a higher flow rate than is ordinary to print the trial printed pattern 46 in the cutting indicia 41 and the sorting indicia 42. In printing the head check pattern 47, nozzles of odd numbers among those in the black printing nozzle array are driven, and print pixels P of odd numbers to obtain the patterned line 47*a*. Then the continuous recording sheet 17 is fed by an amount of one line. Nozzles of even numbers among those in the black printing nozzle array are driven, and print pixels P of even numbers to obtain the patterned line 47*b*. Similarly, the patterned lines 47*c*–47*h* of the yellow, magenta and cyan colors are formed.

In FIG. 1, the pattern reading line sensor 45 in the cutter 13 detects the cutting indicia 41 and the sorting indicia 42 to designate a cutting position. Also, the pattern reading line sensor 45 detects density of each of the pixels P in the head check pattern 47 in the cutting indicia 41 and the sorting indicia 42. If the density of some of the pixels P is equal to or lower than the reference density, then the nozzles having printed those pixels are detected failing nozzles. In the course of next operation of a trial printed pattern in the cutting indicia 41 or the sorting indicia 42, the failing nozzles are caused to eject ink at a higher amount than other normal nozzles. The failing nozzles are cleaned not only during the cleaning operation of the particular color ink but also while nozzles for other colors are cleaned. Thus, choking of ink can be eliminated.

In the present embodiment, all the nozzles including failing nozzles are caused to eject ink for cleaning. However, it is possible to cause only failing nozzles among all the nozzles to eject ink for the purpose of cleaning and eliminating choking of ink.

In FIG. 3, a portion including the cutting indicia 41 or the sorting indicia 42 is cut away from the continuous recording sheet 17 by cutting along the cutting lines 80 and 81 in response to a detection signal of detecting the cutting indicia 41 or the sorting indicia. 42. At the start of printing, the cutting indicia 41 has been printed in a portion along a front edge of the images 40. Now, the front portion along the borderline of the images 40 is cut away. If the sorting indicia 42 is detected, the image is cut away in the position of the sorting indicia 42 similarly to the cutting indicia 41. In addition, a sorting signal is generated and output to inform an end of a series of the images related to a printing request. If there remains no image to be printed, then the front edge of the continuous recording sheet 17 is returned to the pinch roller 23 in the image forming component 11, and becomes ready for printing.

In the present embodiment, a width of the continuous recording sheet 17 is 100 mm. A size of one image including the cutting indicia is 150 mm in the feeding direction. A speed of feeding the continuous recording sheet 17 is 30 mm/sec. A range of printing of the printing head 24 in the course of one pass is 100 mm. However, a speed of feeding the continuous recording sheet 17 can be 20 mm/sec or higher. A range of printing of the printing head 24 in the course of one pass is 80 mm or more. Ink can be dried quickly without lowering the printing speed.

In the above embodiment, each of unit drying regions HA corresponds to 1,000 unit ink ejected regions IPA defined by the nozzles 30–33 of the printing head 24. However, the number of unit ink ejected regions IPA corresponding to each unit drying region HA can be changed in any suitable manner.

In the above embodiment, there is an increasing correlation of heat energy applied by the cutting indicia 41 to the unit drying region HA according to an increase in the ejected amount of ink for the unit drying region HA. See FIG. 10. Even when ink of a very small amount is ejected, the heaters 51 are driven. Alternatively, the heaters 51 may be kept without application of heat when ink of a very small amount is ejected. Only air may be sent for drying. This is effective in reducing expense of electric power by economizing heat energy.

In the above embodiments, heat energy to be generated by each of the heaters 51 is controlled according to the ejected amount of ink for the unit drying regions HA. Alternatively, a flow rate of air of the fans 52 may be controlled. Also, the control in the flow rate of air of the fans 52 may be added to the control of the heaters 51. Also, it is possible for the heaters 51 to heat the continuous recording sheet 17 in a regularized manner of heat energy or air flow rate without being changed for the ejected amount of ink. In addition, heat energy to be applied to the unit drying region HA can be changed in a stepwise manner. For example, it is possible only to preset two or three steps of heat energy to be used for drying. Alternatively, it is possible to obtain a total ejected amount of ink per printing line, and to control heat energy of the heater or flow rate of the fan according to the total ejected amount. The drier 25, instead of having the fans 52, may include an air compressor or blower to blow with compressed air.

Note that, instead of using the drier 25 for supply of hot air to the continuous recording sheet 17, a thermal head may be disposed upstream from the printing head 24 with reference to feeding of the continuous recording sheet 17, and preheat the continuous recording sheet 17 with energy according to the ejected amount of ink. Heat energy of preheating may be determined with differences between pixels, but also may be determined equally in a simple manner between pixels. Also, a heater may be incorporated in the platen roller 21 instead of using the drier 25 or thermal head, to heat the continuous recording sheet 17 to dry the ink. Furthermore, ink can be dried naturally with time without using the drier 25 or preheating device.

Figure 11:
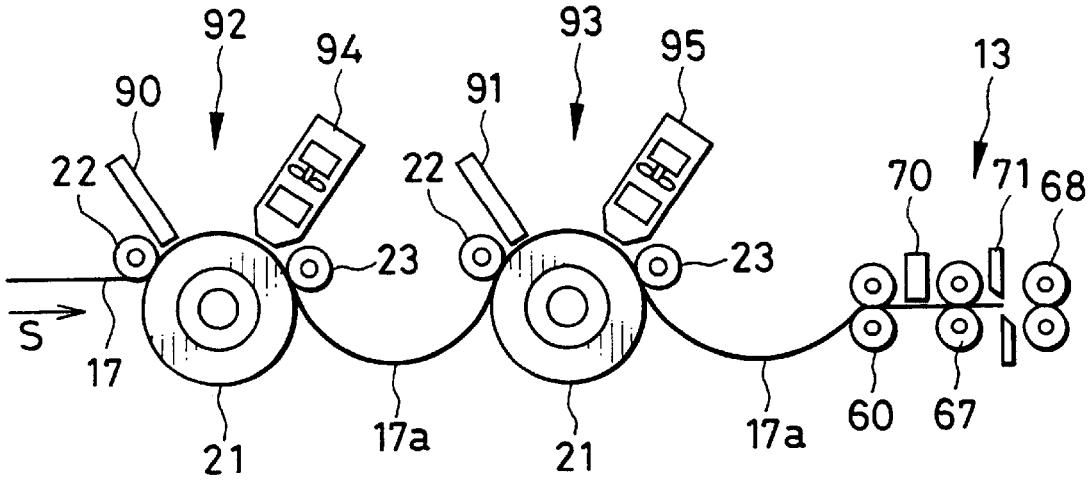
FIG. 11 is an elevation illustrating another preferred ink jet printer having two printing heads.

In the above embodiments, the printing head 24 includes the arrays of the nozzles 30–33 as illustrated in FIG. 2. However, plural printing heads may be used in an ink jet printer. In FIG. 11, two image forming components 92 and 93 are defined in the ink jet printer. The image forming component 92 includes an ink jet printing head 90 having an array of nozzles for black ink. The image forming component 93 includes an ink jet printing head 91 having arrays of nozzles for yellow, magenta and cyan ink. Driers 94 and 95 are positioned downstream from respectively the printing heads 90 and 91 in the image forming components 92 and 93. Looped portions 17*a* of the continuous recording sheet 17 are formed between the image forming components 92 and 93 and between the image forming component 93 and the cutter 13, and are adapted to avoiding transmission of minute movement of the continuous recording sheet 17 from one of the image forming components 92 and 93 to the remainder. Note that elements in FIGS. 11–15 similar to those of the above embodiments are designated with identical reference numerals in FIG. 1.

In general, a color image of an ordinary type requires a smaller amount of black ink than amounts of ink of other colors. In view of this, the printing head 90 for the black color is disposed upstream from the printing head 91. The black ink can be dried quickly before ejection of ink of the other colors for the reason of a relatively small amount of black ink. Thus, the total operation of drying can be quick.

Figure 12:
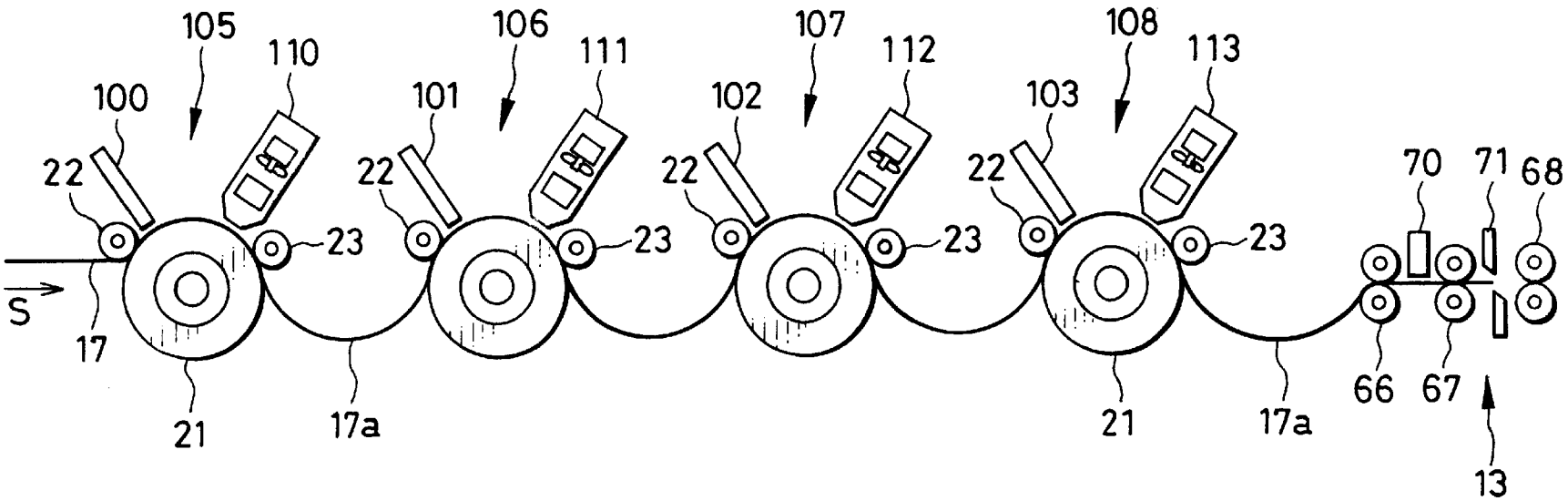
FIG. 12 is an elevation illustrating another preferred ink jet printer having four printing heads.

In FIG. 12, another preferred ink jet printer is depicted, including four image forming components 105, 106, 107 and 108. Ink jet printing heads 100, 101, 102 and 103 are disposed in respectively the image forming components 105, 106, 107 and 108, and eject respectively black, yellow, magenta and cyan ink. Driers 110, 111, 112 and 113 are positioned downstream from respectively the printing heads 100–103, and apply hot air to the continuous recording sheet 17 for drying according to ejected amounts of ink to the unit drying regions HA. Note that the printing head 100 is disposed upstream from the printing heads 101–103 in the manner similar to the embodiment of FIG. 11. This arrangement is advantageous in efficient drying.

Furthermore, an ink jet printing head may have plural arrays of the nozzles 30 for black ink. Also, ink jet printing heads may have plural arrays of the nozzles 31–33 for yellow, magenta and cyan ink. The number of linearly arranged nozzles with reference to the main scan direction becomes smaller. Thus, manufacture of the nozzles 30–33 can be still easier. It is also to be noted that plural ink jet printing heads may be combined, may have respectively a smaller size in the main scan direction, to constitute a single head group extending in the main scan direction crosswise to the feeding of the continuous recording sheet 17.

To print an image in the plurality of the image forming components 105–108, it is preferable in the first one of the image forming components 105–108 to print a register indicia in a front end portion of the continuous recording sheet 17 outside the image to avoid offsetting of a position to print the image. Even when a certain image has an indistinct edge, it is possible to designate the start position for printing an image, because the register indicia can be detected before the printing heads to start printing the colors. If the register indicia is printed with black ink in the image forming component 105, it is particularly possible to detect each register indicia. If there is no space for printing a register indicia, it is possible to use the cutting indicia 41, the sorting indicia 42 or the like to designate the start position for printing an image.

Figure 13A:
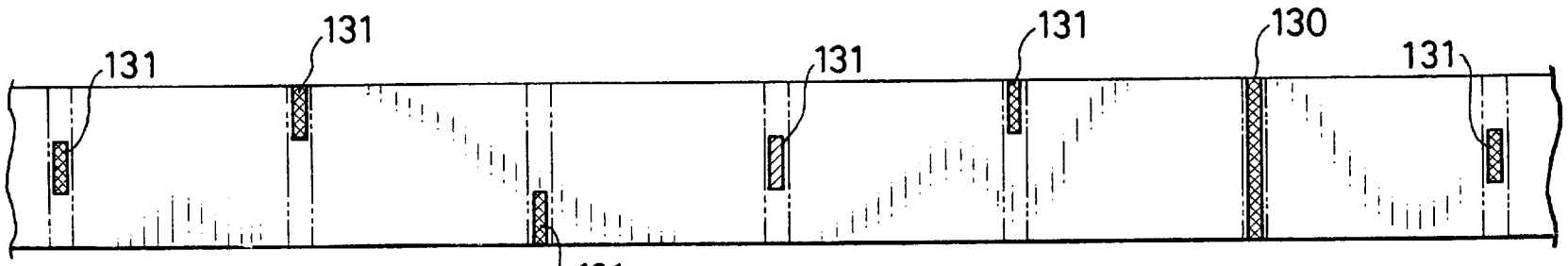
FIG. 13A is an explanatory view in plan, illustrating another preferred embodiment in which each cutting indicia is smaller than the sorting indicia.
Figure 13B:
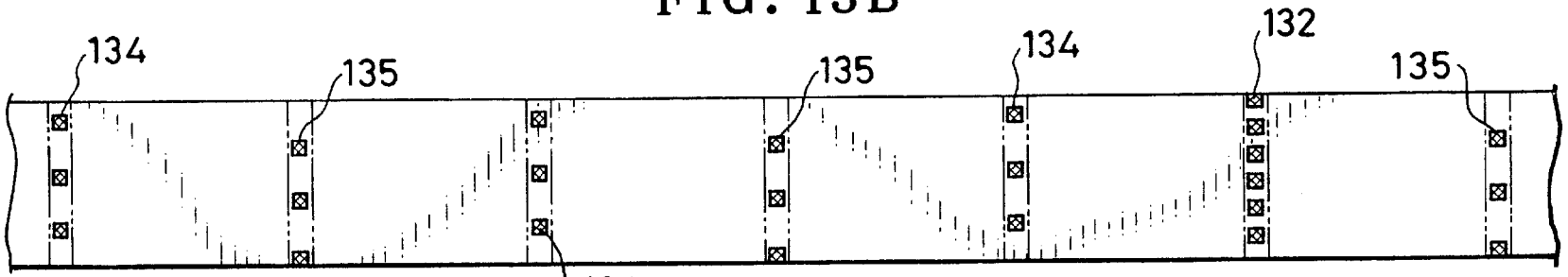
FIG. 13B is an explanatory view in plan, illustrating a preferred embodiment in which cutting indicia and a sorting indicia are constituted by plural dots.
Figure 13C:
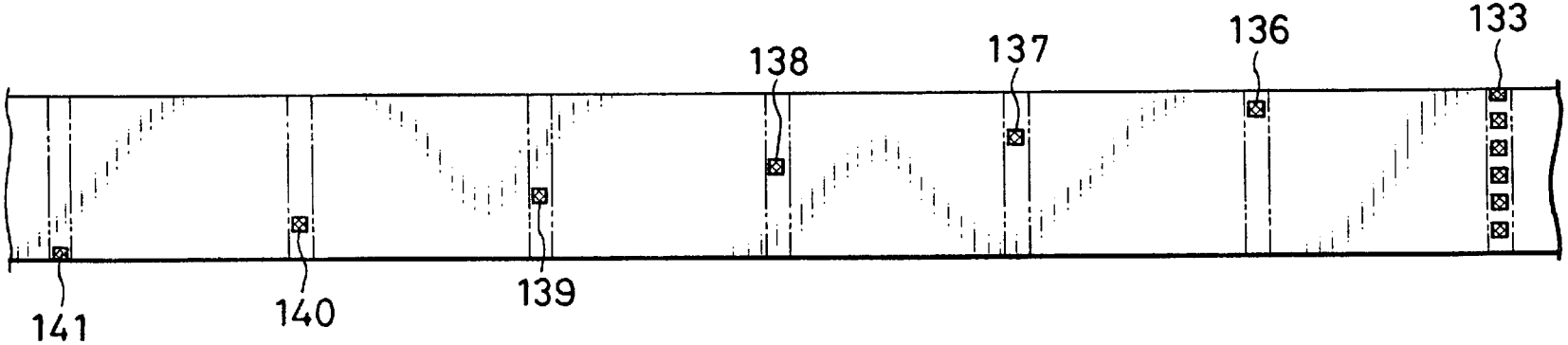
FIG. 13C is an explanatory view in plan, illustrating still another preferred embodiment, having cutting indicia formed in various positions and a sorting indicia having a train of plural dots.

In FIGS. 13A–13C, preferred embodiments are illustrated in which a shape or position of a sorting indicia and cutting indicia is changed for discernment. In FIG. 13A, a sorting indicia 130 is printed to extend for the whole width of the continuous recording sheet 17. A cutting indicia 131 is printed to extend at a smaller width in the same direction. Sizes of the sorting indicia 130 and the cutting indicia 131 according to the main scan direction crosswise to the feeding of the continuous recording sheet 17 are detected, so the sorting indicia 130 and the cutting indicia 131 can be recognized distinctly. Note that each of the sorting indicia 130 and the cutting indicia 131 is constituted by a combination of the trial printed pattern 46 and the head check pattern 47. However, only the head check pattern 47 may constitute each of the sorting indicia 130 and the cutting indicia 131. In conclusion, all the nozzles are checked by cleaning at the beginning of a series of images related to one request of printing. Part of all the nozzles are checked at each time of printing one image. Wasteful use of ink for the purpose of cleaning can be prevented.

In FIGS. 13B and 13C, sorting indicia 132 and 133 can be used to check approximately a half of all the nozzles. Plural cutting indicia 134, 135, 136, 137, 138, 139, 140, and 141 can be used to check approximately a remaining half of all the nozzles. This reduces the number of times of checking each of the nozzles. The total amount of ejected ink can be lower, to economize the use of ink.

Figure 14:
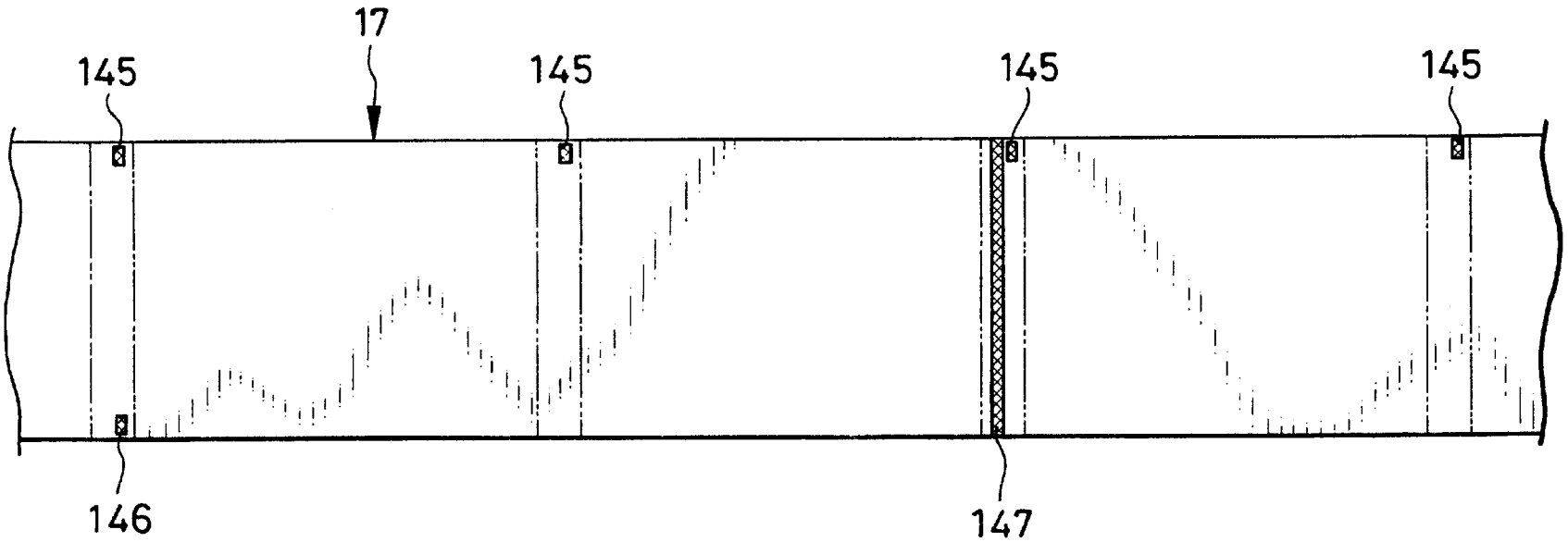
FIG. 14 is an explanatory view in plan, illustrating another preferred embodiment having a head check pattern separate from a cutting indicia or sorting indicia.

Furthermore, a head check pattern may be separate from a cutting indicia or sorting indicia. In FIG. 14, a preferred embodiment is depicted. A cutting indicia 145 is printed in the continuous recording sheet 17 as a colored zone in a quadrilateral shape. A sorting indicia 146 is printed in the same shape but positioned opposite to the cutting indicia 145. A head check pattern 147 is printed along a borderline between images. at each time that ten images are printed. Note that the sorting indicia 146 may be distinct from the cutting indicia 145 in the shape or color instead of the position. For example, the cutting indicia 145 may be circular while the sorting indicia 146 may be quadrilateral or triangular. Furthermore, a head check pattern may be printed cyclically in other predetermined manner. For example, a head check pattern may be printed at the beginning of a series of images according to a single request for printing. A head check pattern may be printed immediately after a roll of the continuous recording sheet 17 is renewed. A head check pattern may be printed immediately upon a start of printing after powering. A head check pattern may be printed at each time of lapse of ten minutes or other predetermined time. Also, the head check pattern 47 may be printed simply without printing the trial printed pattern 46.

In the above embodiments, the head check pattern 47 includes the patterned lines or patterned points of all the four colors. However, plural kinds; of head check patterns may be determined respectively for the colors, and printed in positions at image borderlines cyclically one after another. For example, the patterned lines 47*a* and 47*b* of black for head checking may be printed at a first borderline of images. The patterned lines 47*c* and 47*d* of yellow for head checking may be printed at a second borderline of the images after the first borderline. The patterned lines 47*e* and 47*f* of magenta for head checking may be printed at a third borderline. The patterned lines 47*g* and 47*h* of cyan for head checking may be printed at a fourth borderline.

In the above embodiments, the nozzles 30–33 are driven at a predetermined interval of time between each two nozzles adjacent to one another, to print pixels at a regular interval. Pixels can be checked reliably even if the density of arrangement of the photo receptor elements 45*a* is lower than density of arrangement of the nozzles 30–33. However, it is possible in the present invention to drive the nozzles 30–33 simultaneously for the purpose of printing the head check pattern in a shape of a straight line. This is typically advantageous if the density of arrangement of the photo receptor elements 45*a* is equal to density of arrangement of the nozzles 30–33, or if the pixels are read by scanning of a sensor, which will be described later in detail.

Figure 15:
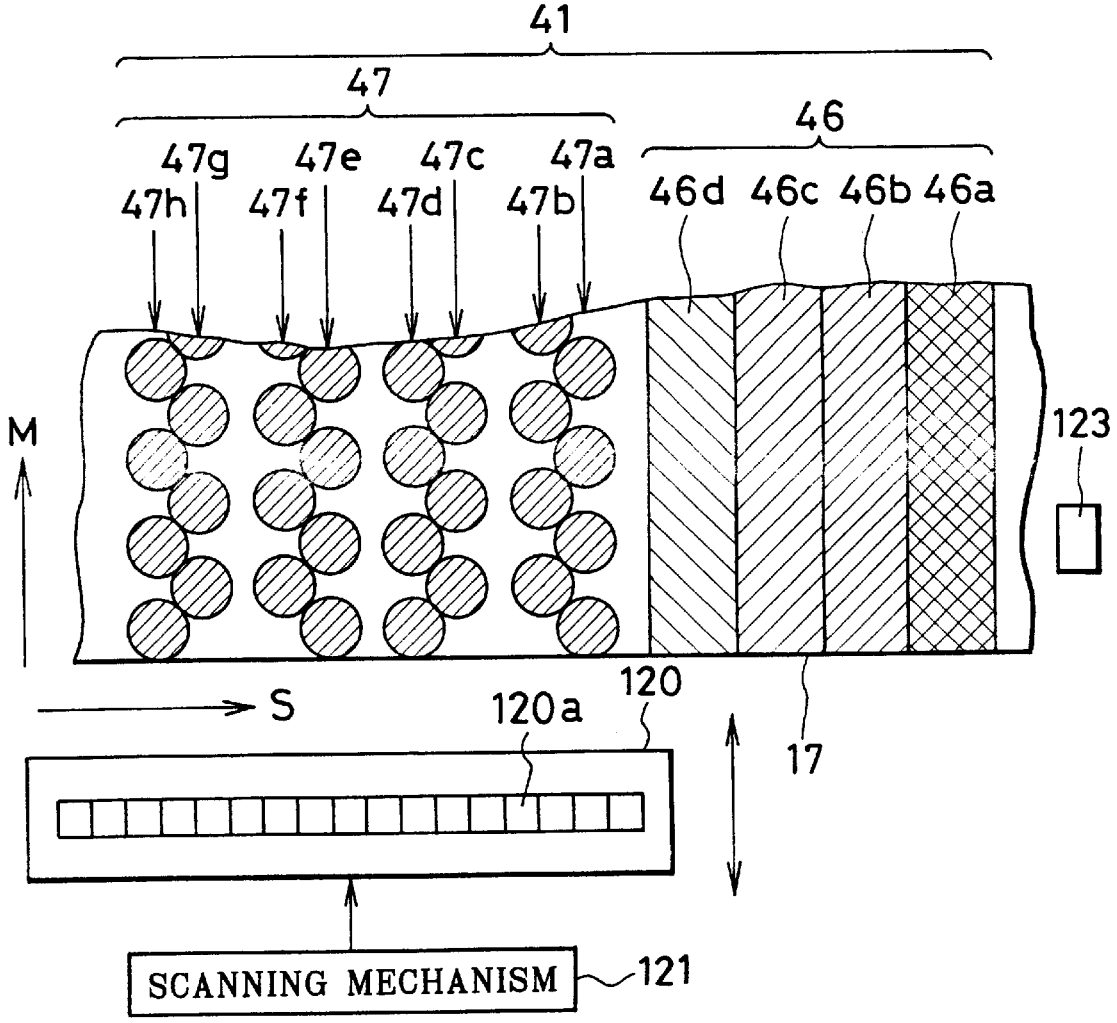
FIG. 15 is an explanatory view in plan, illustrating a preferred embodiment in which a pattern reader or line sensor extending in the feeding direction of the continuous recording sheet.

In FIG. 15, reading of the head check pattern 47 according to another preferred embodiment is depicted. A pattern reader 120 or a line sensor extends in the sub scan direction S that is the feeding direction of the continuous recording sheet 17, and is moved in the main scan direction M to read the head check pattern 47. Photo receptor elements 120*a* are arranged in an array in the pattern reader 120. A scanning mechanism 121 moves the pattern reader 120 in the main scan direction M in a parallel manner. There is an indicia sensor 123, which detects the cutting indicia 41 to generate a detection signal. In response to the detection signal, movement of the continuous recording sheet 17 is controlled to set the head check pattern 47 suitably in the pattern reading position. Furthermore, a pattern reader according to still another embodiment can include a single photo receptor element, which can be moved by the scanning mechanism in the main scan direction M to read the patterned lines by an amount of each one reading line. After the reading, the continuous recording sheet 17 is fed by one reading line to read a succeeding one of the patterned lines. Reading is repeated to detect the whole of the head check pattern finally.

In the above embodiment, the pixels P are associated with the nozzles in such a manner that each pixel P corresponds to one of the nozzles. Alternatively, nozzles may be grouped in such a manner that each of nozzle groups includes two or three nozzles or plural nozzles in a regular number, so as to print one pixel by each nozzle group. Density of the pixels can be detected. If the density is lower than reference density, it is possible to clean particular nozzle groups having printed the low-density pixels.

Figure 16:
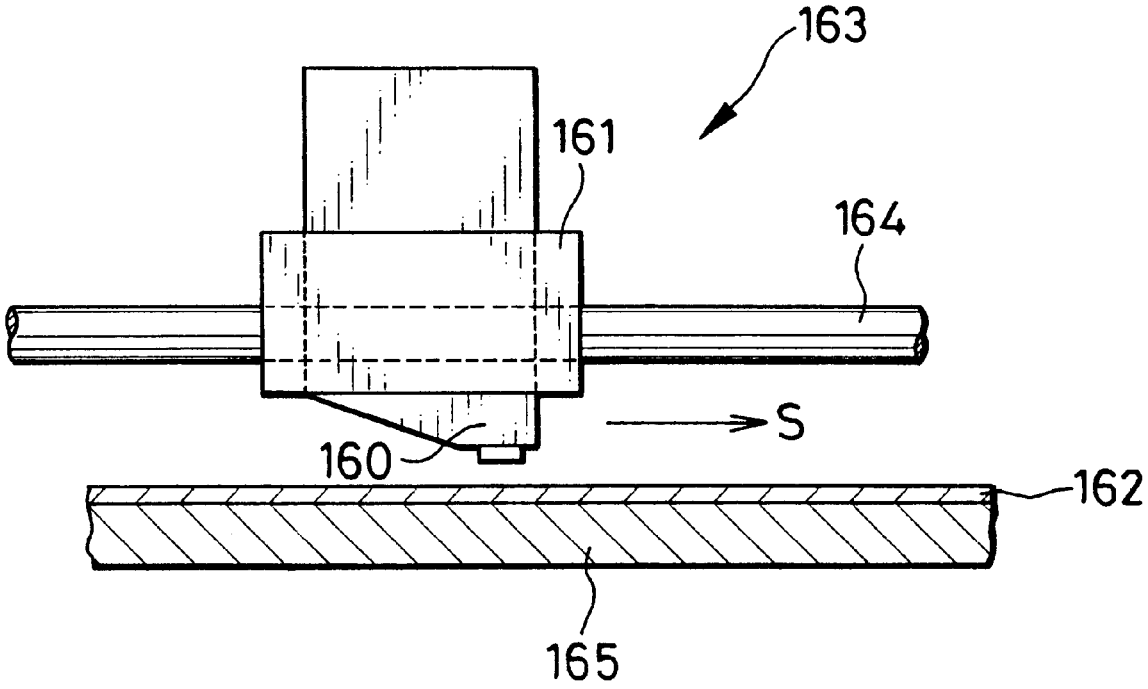
FIG. 16 is a front elevation illustrating a preferred printing head, incorporated in a serial printing type of printer, and movable with a head carriage.

In the above embodiments, the ink jet printers are a line printing type in which an image is printed one line after another in the direction crosswise to the feeding of the continuous recording sheet 17. Also, FIG. 16 illustrates an embodiment of ink jet printer 163 of a serial printing type. An ink jet printing head 160 is disposed in a head carriage 161 as moving mechanism, which moves the printing head 160 in a sub scan direction S crosswise to feeding of continuous recording sheet 162 as recording material. Note that there is a guide rod 164 for guiding the head carriage 161 in the sub scan direction of the continuous recording sheet 162. A platen 165 as second moving mechanism supports the continuous recording sheet 162, and moves the continuous recording sheet 162 in a main scan direction M.

To print a head check pattern in the ink jet printer 163, the head carriage 161 is moved in the sub scan direction S while the nozzles are driven sequentially. Pixels are printed on the continuous recording sheet 162 in a manner along an oblique line.

Figure 17A:
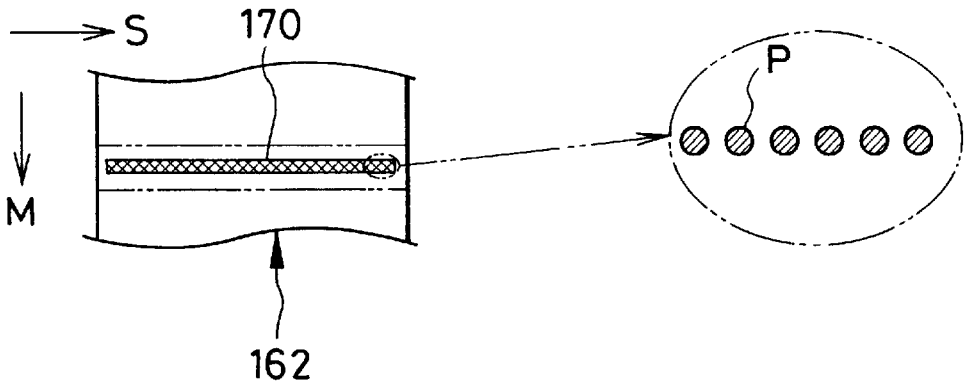
FIG. 17A is an explanatory view in plan, illustrating a head check pattern printed by the printing head of FIG. 16.
Figure 17B:
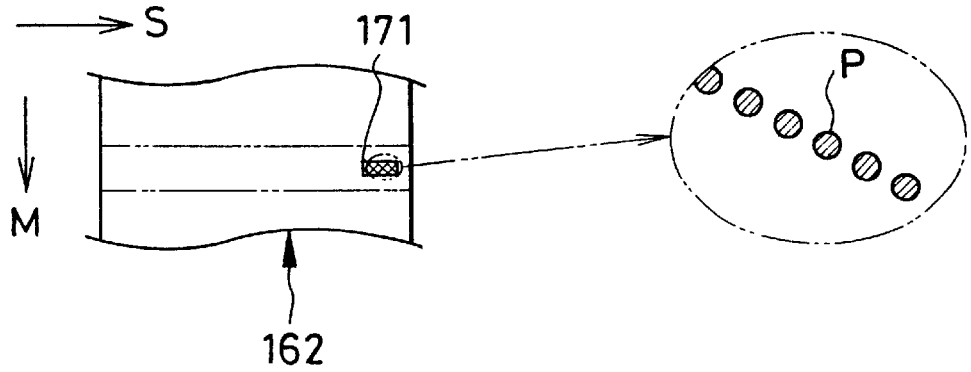
FIG. 17B is an explanatory view in plan, illustrating another head check pattern extending obliquely.
Figure 17C:
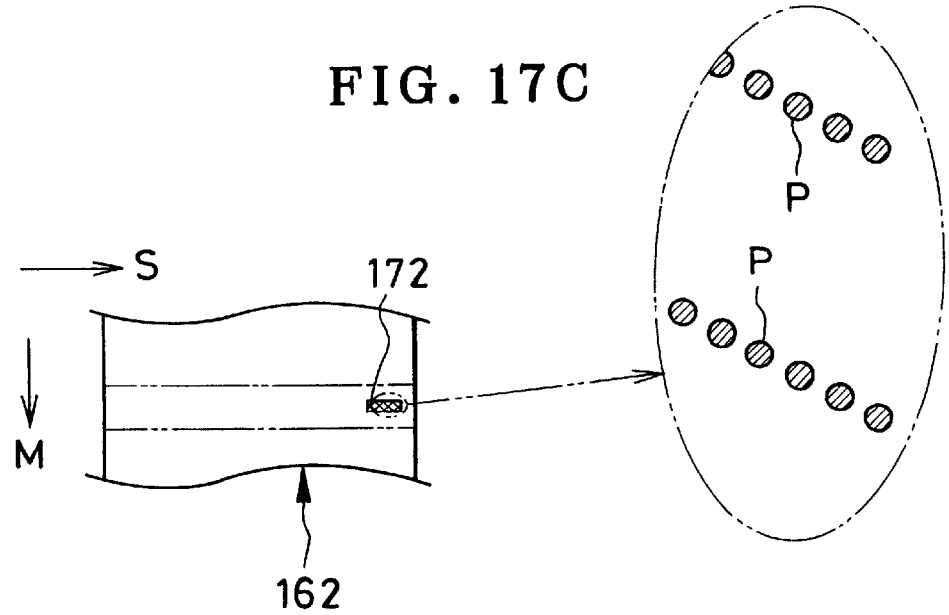
FIG. 17C is an explanatory view in plan, illustrating a head check pattern including two or more oblique portions.

In FIGS. 17A–17C, other examples of head check patterns printed in the ink jet printer 163 are illustrated. In FIG. 17A, the head carriage 161 moves the printing head 160 in the sub scan direction S while the platen 165 feeds the continuous recording sheet 162 in the main scan direction M by one pixel. During this movement, the nozzles are driven sequentially, to form a head check pattern 170. The head check pattern 170 is constituted by pixels P separate from one another in the sub scan direction S in the continuous recording sheet 162.

A head check pattern 171 in FIG. 17B is formed by moving the printing head 160 in the sub scan direction S without moving the continuous recording sheet 162, and by sequentially driving the nozzles. The head check pattern 171 is constituted by pixels P which are arranged in a direction oblique to the continuous recording sheet 162 and separate from one another like points.

In FIG. 17C, a head check pattern 172 is illustrated, which is typically effective when the number of the nozzles is high. The nozzles are grouped into plural groups arranged in the main scan direction. In each group, nozzles are serially driven, to constitute the head check pattern 172 constituted by plural short oblique lines.

Also in the serial printing type of ink jet printer, it is possible to determine the cutting indicia 41 and the sorting indicia 42 by changing the number of times of printing, a printing position, a printing sequence between the colors of the head check patterns 170–172 and/or the trial printed pattern 46.

In the above embodiments, failure in the nozzles in the printing head is detected by detecting choking of ink, failure of driving elements in the nozzles, failure in the driving circuit for the nozzles, or the like. It is to be noted that a printer of the invention may be a type other than an ink jet printer. Failure in recording elements in a certain printer may be detected by any suitable method. For example, a printer may be a thermal printer having a thermal printing head. To remove failure in failing heating elements in the printing head, drive data for the failing heating elements is compensated for by means of compensation data. Furthermore, a printer may be an exposing printing type which includes a printing head having an array of light-emitting elements, and which prints an image to an instant photo film by exposing the same with light controlled according to image data.

In the above embodiments, piezoelectric elements are used in the ink jet printing heads 24, 90, 91 and 100–103. However, other types of structures for ejecting ink may be used in ink jet printing. For example, a flow rate control diaphragm type may be used, in which piezoelectric elements are combined with diaphragms. A thermal ink jet printing may be used, in which heating elements heat liquid ink, generate bubbles and eject the ink. A continuous ink jet printing may be used, in which ink droplets are charged by means of electrodes, and deflection electrodes and separator plates are combined to eliminate and withdraw unnecessary ink droplets, and remaining ink droplets are ejected to the recording material. An electrostatic attraction ink jet printing may be used, in which high voltage is applied according to an image signal, and causes attraction of ink droplets to recording material. An ultrasonic ink jet printing may be used, in which ultrasonic waves are applied to vibrate liquid ink, and generate ink droplets. Furthermore, the colors of ink may be light magenta, light cyan and the like instead of the yellow, magenta, cyan and black colors.

In the above embodiments, a roll type of the continuous recording sheet is used. Also, a recording sheet of a limited size in a quadrilateral shape may be used. In each of the recording sheet, two or more images may be printed in series. The head check pattern is printed in a portion outside an effective image printing region in the recording sheet. Furthermore, a sorting indicia may be printed in the recording sheet as required in addition to the head check pattern.

In the above embodiments, the continuous recording sheet is used to print an image. Also, a recording sheet strip in a long shape but with a smaller length than the continuous recording sheet may be used.

In the above embodiment, the position of the pattern reading line sensor 45 is considerably away from the printing head 24 with reference to a feeding path of the continuous recording sheet. There occurs a delay after printing and inspecting the head check pattern 47 and before printing of the trial printed pattern 46 for the purpose of eliminating failure in the nozzles 30–33. This results in low quality in printing, because at least a portion of a first image is printed by the printing head 24 still including failing nozzles before recovery. If the pattern reading line sensor 45 is very distant, one or more images are printed in low quality.

Accordingly, it is preferable after recovery of failure in the nozzles 30–33 to print again a predetermined number of images directly prior to detection of the failure in the nozzles 30–33. A process of reprinting is described now.

The system controller 36 has a construction to write information of plural images to a memory incessantly, the images being such immediately after being printed. If existence of failing ones of the nozzles 30–33 is detected, then it is determined that a predetermined number of images have been printed at a low quality, the predetermined number depending upon a feeding length from the printing head 24 to the pattern reading line sensor 45. The system controller 36 outputs designation information to designate low-quality prints to inform an operator of the low-quality prints. Furthermore, the information of the images printed at the low quality is read from the memory. The system controller 36 adjusts a sequence of images in relation to the image data so as to print those images between one of remaining images ready to be printed. According to the image data, the printing head 24 of which the nozzles 30–33 are completely recovered is driven. After printing a series of images, the operator refers to the designation information, and eliminates the low-quality prints from prints stacked in a tray. Thus, images as desired can be printed at high quality without exception.

Although the present invention has been fully described by way of the preferred embodiments thereof with reference to the accompanying drawings, various changes and modifications will be apparent to those having, skill in this field. Therefore, unless otherwise these changes and modifications depart from the scope of the present invention, they should be construed as included therein.

What is claimed is:

1. A printing method, in which a printing head is used, and includes plural recording elements arranged in a main scan direction, said printing method comprising steps of:

printing at least one image to recording material by moving one of said printing head and said recording material relative to a remainder thereof in a sub scan direction; and printing a head check pattern with said printing head to said recording material outside a region of said image, said head check pattern being adapted to check whether said recording elements print at intended printing density.

2. A printing method as defined in claim 1, wherein said at least one image is plural images, and said head check pattern is printed to said recording material in a position between said plural images, in a position defined upstream therefrom, or in a position defined downstream therefrom.

3. A printing method as defined in claim 2, further comprising a failure designating step of designating failing recording elements among said plural recording elements associated with pixels with low printing density within said head check pattern.

4. A printing method as defined in claim 3, further comprising a step of printing cutting indicia to said recording material in respectively positions between said plural images, said cutting indicia being adapted to cut said recording material.

5. A printing method as defined in claim 4, further comprising a step of, before printing said head check pattern, printing a trial printed pattern to said recording material with said printing head.

6. A printing method as defined in claim 5, wherein said head check pattern and said trial printed pattern are combined to constitute at least one of said plural cutting indicia.

7. A printing method as defined in claim 6, wherein said printing head is an ink jet printing head, said plural recording elements are constituted by plural nozzles for ejecting an ink droplet to said recording material;

said trial printed pattern is printed for cleaning said nozzles.

8. A printing method as defined in claim 7, wherein said head check pattern is printed before printing said image;

further comprising a step of, after printing said image and after said failure designating step, ejecting an ink droplet from at least failing nozzles among said plural nozzles, to print a second trial printed pattern to said recording material.

9. A printing method as defined in claim 8, further comprising a step of, after printing said second trial printed pattern, printing a second head check pattern with said printing head to said recording material, said second head check pattern being adapted to check whether said nozzles print at intended printing density;

wherein said second head check pattern and said second trial printed pattern are combined with one another to constitute said cutting indicia.

10. A printing method as defined in claim 7, wherein said head check pattern is printed in association with each of said plural images, or printed in a position between plural series of said images, or printed upon lapse of predetermined time, or printed when a roll of said recording material is replaced with a roll of new recording material.

11. A printing method as defined in claim 10, wherein said plural series are associated, with respectively one request for printing, or each of said plural series includes a predetermined number of images.

12. A printing method as defined in claim 7, wherein said recording material is continuous recording sheet or a recording sheet strip;

further comprising a step of printing a sorting indicia to said recording material in a position between plural series of said images, said sorting indicia being discernible from said cutting indicia and adapted to designating said series of said images.

13. A printing method as defined in claim 12, wherein said sorting indicia is different from said cutting indicia in at least one of a width, length, position, color and shape.

14. A printing method as defined in claim 12, wherein said cutting indicia are constituted by respectively a combination of said head check pattern and a first type of said trial printed pattern, and said sorting indicia is constituted by respectively a combination of said head check pattern and a second type of said trial printed pattern, said second type being discernible from said first type.

15. A printing method as defined in claim 12, wherein said failure designating step includes generating an alarm signal for recovery of said failing recording elements.

16. A printing method as defined in claim 12, further comprising a step of, after said failure designating step, sucking ink from failing nozzles among said plural nozzles for recovery, or wiping said failing nozzles for recovery.

17. A printing method, in which a printing head is used, and includes plural recording elements arranged in a main scan direction, said printing method comprising steps of:

moving said printing head with a head carriage in a sub scan direction for image printing in a belt shape; and moving one of said head carriage and recording material relative to a remainder thereof in said main scan direction, to print at least one image; and printing a head check pattern with said printing head outside a region of said image in said recording material, said head check pattern being adapted to check whether said recording elements print at intended printing density.

18. A printing method as defined in claim 17, wherein at least one image is plural images, and said head check pattern is printed to said recording material in a position between said plural images, in a position defined upstream therefrom, or in a position defined downstream therefrom.

19. A printing method as defined in claim 18, further comprising a step of designating failing recording elements among said plural recording elements associated with pixels with low printing density within said head check pattern.

20. A printer comprising:

a printing head, including plural recording elements arranged in a main scan direction;

a moving mechanism for moving one of said printing head and recording material relative to a remainder thereof in a sub scan direction; and a controller for driving said printing head and said moving mechanism to print at least one image and a head check pattern to said recording material, said head check pattern being printed outside a region of said image, and adapted to check whether said recording elements print at intended printing density.

21. A printer as defined in claim 20, further comprising:

a frame memory, connected with said controller, for storing information of said image;

a pattern memory, connected with said controller, for storing information of said head check pattern.

22. A printer as defined in claim 21, wherein said at least one image is plural images, and said head check pattern is printed to said recording material in a position between said plural images, in a position defined upstream therefrom, or in a position defined downstream therefrom.

23. A printer as defined in claim 22, further comprising a pattern reader for reading said head check pattern;

wherein said controller designates failing recording elements among said plural recording elements by extracting pixels with low printing density within said head check pattern being read.

24. A printer as defined in claim 23, wherein said controller causes said printing head to print cutting indicia to said recording material in respectively positions between said plural images, said cutting indicia being adapted to cut said recording material.

25. A printer as defined in claim 24, wherein said controller, before printing said head check pattern, causes said printing head to print a trial printed pattern to said recording material.

26. A printer as defined in claim 25, wherein said head check pattern and said trial printed pattern are combined to constitute at least one of said plural cutting indicia.

27. A printer as defined in claim 26, wherein said printing head is an ink jet printing head, said plural recording elements are constituted by plural nozzles for ejecting an ink droplet to said recording material;

said trial printed pattern is printed for cleaning said nozzles.

28. A printer as defined in claim 27, wherein said printing head prints said head check pattern before printing said image;

said controller, after printing said image, further causes at least failing nozzles among said plural nozzles to eject an ink droplet, to print a second trial printed pattern to said recording material.

29. A printer as defined in claim 28, wherein said controller, after printing said second trial printed pattern, causes said printing head to print a second head check pattern to said recording material, said second head check pattern being adapted to check whether said nozzles print at intended printing density;

said second head check pattern and said second trial printed pattern are combined with one another to constitute said cutting indicia.

30. A printer as defined in claim 27, wherein said printing head prints said head check pattern in association with each of said plural images, or prints said head check pattern in a position between plural series of said images, or prints said head check pattern upon lapse of predetermined time, or prints said head check pattern when a roll of said recording material is replaced with a roll of new recording material.

31. A printer as defined in claim 27, wherein said recording material is continuous recording sheet or a recording sheet strip;

said controller further causes said printing head to print a sorting indicia to said recording material in a position between plural series of said images, said sorting indicia being discernible from said cutting indicia and adapted to designating said series of said images.

32. A printer as defined in, claim 31, wherein said cutting indicia are constituted by respectively a combination of said head check pattern and a first type of said trial printed pattern, and said sorting indicia is constituted by respectively a combination of said head check pattern and a second type of said trial printed pattern, said second type being discernible from said first type.

33. A printer comprising:

a printing head, including plural recording elements arranged in a main scan direction, for image printing in a belt shape;

a head carriage for moving said printing head in a sub scan direction;

a moving mechanism for moving one of said head carriage and recording material relative to a remainder thereof in said main scan direction; and a controller for driving said ;printing head, said head carriage, and said moving mechanism to print at least one image and a head check pattern to said recording material, said head check pattern being printed outside a region of said image, and adapted to check whether said recording elements print at intended printing density.

* * * * *